US012798041B2

(12) United States Patent
Kanno

(10) Patent No.: US 12,798,041 B2
(45) Date of Patent: Nov. 17, 2026

(54) POLISHING APPARATUS AND POLISHING METHOD

(71) Applicant: Fujikoshi Machinery Corp., Nagano (JP)

(72) Inventor: Yuya Kanno, Nagano (JP)

(73) Assignee: FUJIKOSHI MACHINERY CORP., Nagano (JP)

( * ) Notice: Subject to any disclaimer, the term of this patent is extended or adjusted under 35 U.S.C. 154(b) by 293 days.

(21) Appl. No.: 18/724,971

(22) PCT Filed: Apr. 3, 2023

(86) PCT No.: PCT/JP2023/013752

§ 371 (c)(1),
(2) Date: Jun. 27, 2024

(87) PCT Pub. No.: WO2023/228579

PCT Pub. Date: Nov. 30, 2023

(65) Prior Publication Data

US 2024/0399529 A1 Dec. 5, 2024

(30) Foreign Application Priority Data

May 26, 2022 (JP) ..... 2022-086390

(51) Int. Cl.
*B24B 37/04* (2012.01)

(52) U.S. Cl.
CPC ..... *B24B 37/042* (2013.01)

(58) Field of Classification Search
CPC ..... B24B 57/00; B24B 57/02; B24B 1/04; B24C 5/04; B24C 1/10; B05B 1/16
See application file for complete search history.

(56) References Cited

U.S. PATENT DOCUMENTS 11,339,311 B2 5/2022 Ito et al.
2010/0116900 A1* 5/2010 Wurz ..... B05B 7/066 239/8

(Continued)

FOREIGN PATENT DOCUMENTS

CN 107717687 2/2018
EP 3450104 B1 * 1/2022 ..... B33Y 40/20

(Continued)

OTHER PUBLICATIONS

Machine translation of JP-2003179018-A (Year: 2003).*
International Search Report dated May 18, 2024 in International Application No. PCT/JP2023/013752.

*Primary Examiner* — Robert F Neibaur
(74) *Attorney, Agent, or Firm* — Stephen J. Weyer, Esq.; Stites & Harbison, PLLC

(57) ABSTRACT

An object is to provide a polishing apparatus and a polishing method with which surface modification is implemented on a workpiece surface in consideration of the distribution of recesses and protrusions on the workpiece surface and with short-time processability improved. As a solution, a polishing apparatus (10) polishes a workpiece (W) under the following requirements. The polishing apparatus (10) includes a cavitation generating emission device (50). The cavitation generating emission device (50) has an inner tube (54) in which a first liquid flow (A) flows. The inner tube (54) includes a cavitation generating unit (54*a*). The cavitation generating emission device (50) is configured to generate cavitation in the first liquid flow (A) and make the first liquid flow (A) collide with the workpiece (W).

5 Claims, 7 Drawing Sheets

(56) References Cited

U.S. PATENT DOCUMENTS

| | | | | |
|---|---|---|---|---|
| 2015/0262833 | A1 | 9/2015 | Shibuya et al. | |
| 2017/0301573 | A1* | 10/2017 | Shibuya | B24B 37/04 |
| 2020/0399505 | A1 | 12/2020 | Ito et al. | |
| 2021/0387309 | A1* | 12/2021 | Sanders | B05B 1/14 |
| 2022/0161387 | A1* | 5/2022 | Yeo | B24B 19/14 |

FOREIGN PATENT DOCUMENTS

| | | | |
|---|---|---|---|
| JP | 1-252361 | | 10/1989 |
| JP | 6-47671 | | 2/1994 |
| JP | 2003-179018 | | 6/2003 |
| JP | 2003179018 | A * | 6/2003 |
| JP | 2006-255865 | | 9/2006 |
| JP | 2015-186838 | | 10/2015 |
| JP | 2017-192995 | | 10/2017 |
| JP | 2021-194642 | | 12/2021 |
| WO | WO-2019/138846 | | 7/2019 |

* cited by examiner

POLISHING APPARATUS AND POLISHING METHOD

TECHNICAL FIELD

The present invention relates to a polishing apparatus and a polishing method for polishing a workpiece that is, for example, a wafer made of silicon carbide (SiC) or the like.

BACKGROUND ART

For polishing of a surface of a wafer made of a high hardness material such as silicon carbide (SiC) (hereinafter, may be simply referred to as "workpiece"), there has been known a method of providing a polishing composition on the surface. In PTL 1 (WO2019/138846), a polishing composition is used that includes water, abrasive grain, an oxidant, and a polishing accelerator (polishing accelerator including at least one type of metal salt selected from the group consisting of alkaline metal salts and alkaline earth metal salts). The oxidant modifies the surface of the workpiece, and the modified layer is removed through friction with the abrasive grain and a polishing pad and the like. The metal salt exhibits catalytic effect of promoting the modification and the removal. With these features, a polishing rate is improved for the polishing of the surface of the workpiece made of the high hardness material.

CITATION LIST

Patent Literature

PTL 1: WO2019/138846

SUMMARY OF INVENTION

Technical Problem

The surface of the workpiece has a form with recess and protrusion shapes randomly distributed. Thus, with the polishing method in which the polishing composition is uniformly provided on the surface of the workpiece as described in PTL 1, the surface of the workpiece cannot be polished in consideration of the distribution of the recesses and the protrusions. More specifically, there has been a problem in that the polishing cannot be performed with short-time processability improved locally (spot by spot) for only a predetermined portion of the surface of the workpiece (the protrusions on the workpiece surface, for example).

Solution to Problem

In view of this, the present invention has been made to solve the problem described above, and an object of the present invention is to provide a polishing apparatus and a polishing method with which polishing can be performed with processability improved locally (spot by spot) for only a predetermined portion of a surface of a workpiece.

A polishing apparatus according to the present invention is a polishing apparatus that polishes a workpiece under the following requirements: the polishing apparatus including a cavitation generating emission device, the cavitation generating emission device having an inner tube in which a first liquid flow flows, the inner tube including a cavitation generating unit, the cavitation generating emission device being configured to generate cavitation in the first liquid flow and make the first liquid flow collide with the workpiece.

A polishing method according to the present invention is a polishing method for polishing a workpiece under the following requirements: the polishing method including a cavitation generating emission step of generating cavitation in a first liquid flow and causing the first liquid flow to collide with the workpiece, and a polishing step of then polishing the workpiece.

Advantageous Effects of Invention

According to the present invention, the surface modification (oxidation) can be implemented on the surface of the workpiece by making the first liquid flow including the cavitation collide with the surface of the workpiece, so that the hardness can be reduced. Thus, the polishing can be performed with the short-time processability improved locally (spot by spot) only for a predetermined portion of the surface of the workpiece.

DESCRIPTION OF EMBODIMENTS

Figure 1:
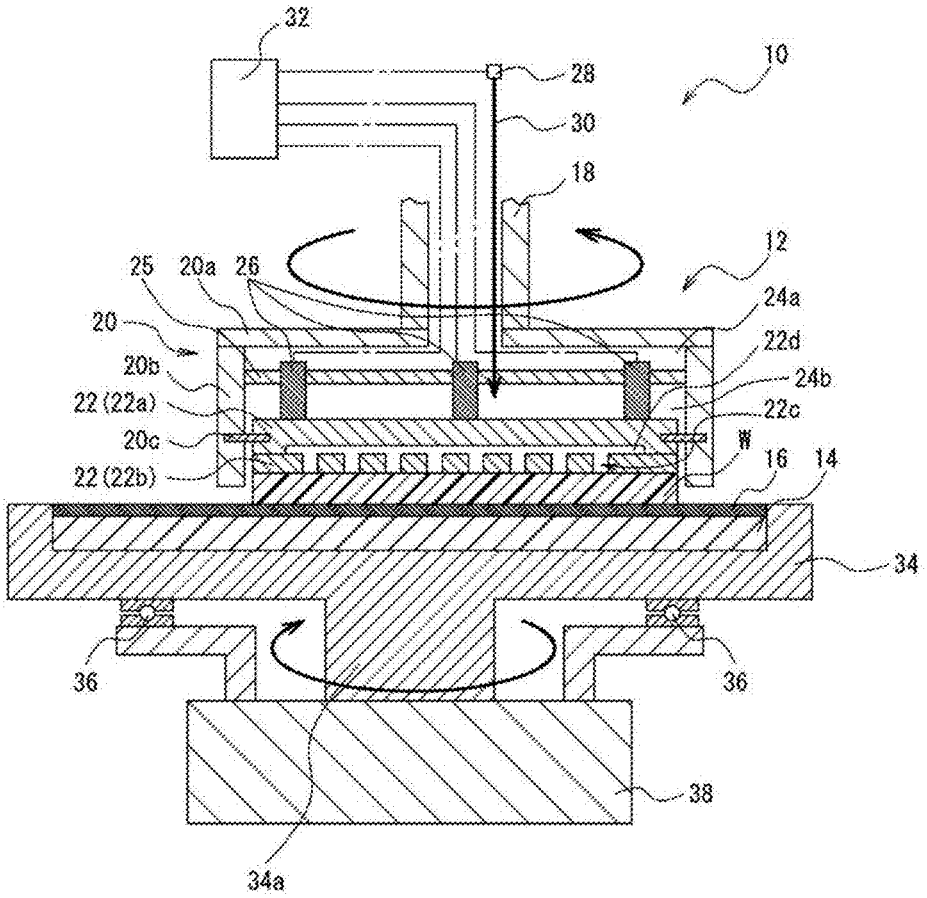
FIG. 1 is a front cross-sectional view illustrating an example of a polishing head and a surface plate of a polishing apparatus according to an embodiment of the present invention.
Figure 2:
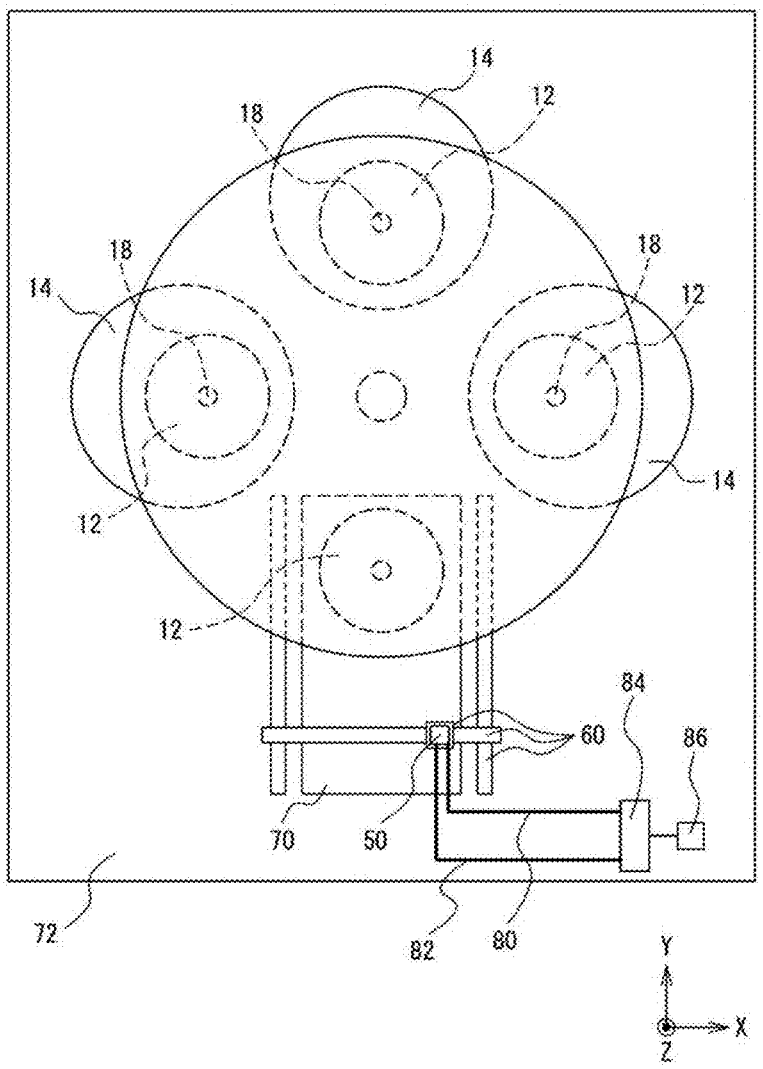
FIG. 2 is a plan view illustrating an example of arrangement of polishing heads, surface plates, and a cavitation generating emission device according to the embodiment of the present invention.
Figure 3:
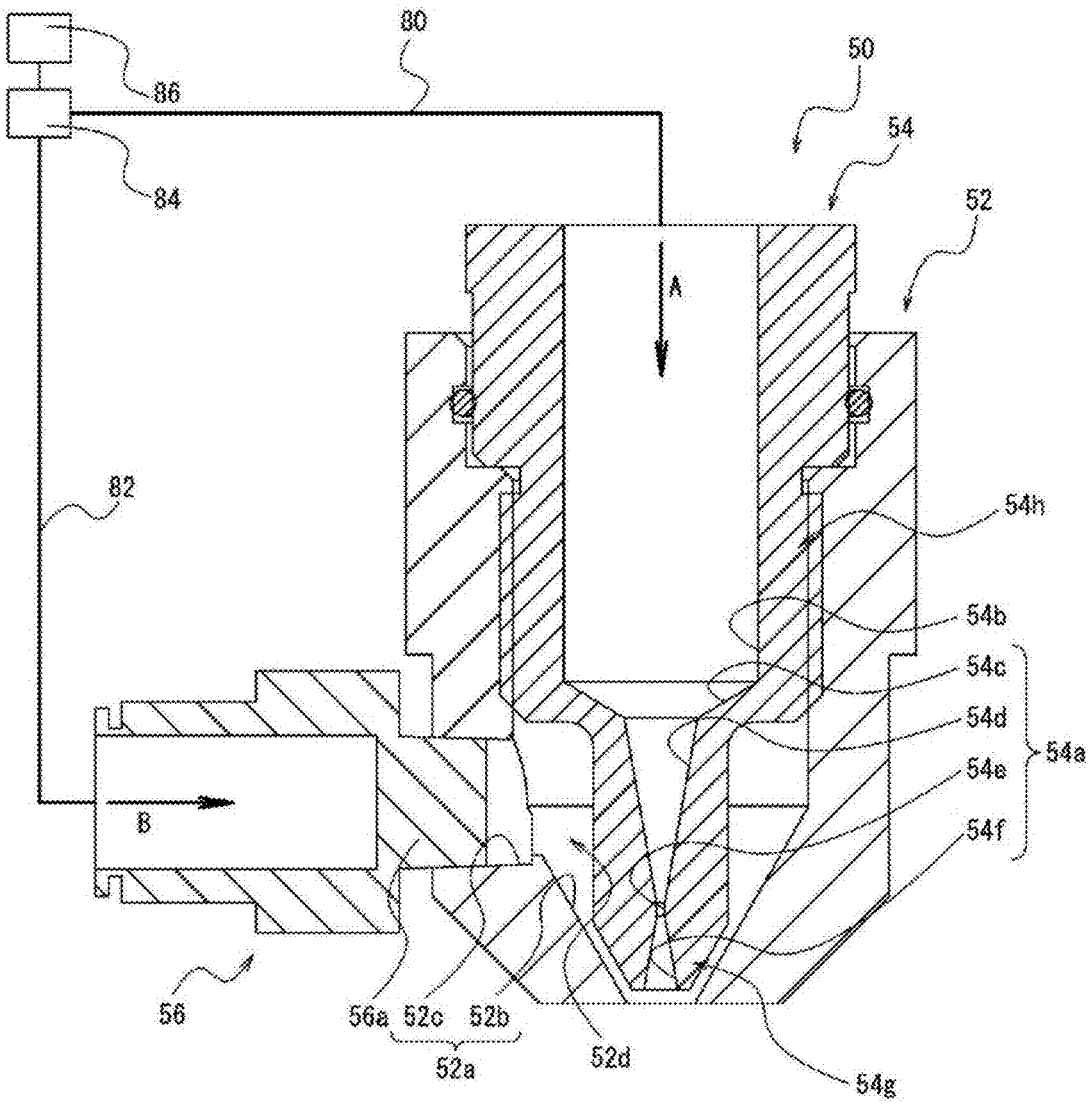
FIG. 3 is a front cross-sectional view illustrating an example of the cavitation generating emission device according to the embodiment of the present invention.

Embodiments of the present invention will be described below in detail with reference to the drawings. FIG. 1 is a front cross-sectional view (schematic view) illustrating an example of a polishing head 12 and a surface plate 14 of a polishing apparatus 10 according to an embodiment of the present invention. FIG. 2 is a plan view (schematic view) illustrating an example of arrangement of polishing heads 12, surface plates 14, and a cavitation generating emission device 50 according to the embodiment of the present invention. FIG. 3 is a front cross-sectional view (schematic view) illustrating an example of the cavitation generating emission device 50 according to the embodiment of the present invention. In all the diagrams for the description of the present embodiment, members having the same functions are denoted with the same reference numerals, and may not be redundantly described.

First of all, the polishing apparatus 10 according to the present embodiment includes four polishing heads 12, three surface plates 14, and one cavitation generating emission device 50 as illustrated in FIG. 1 and FIG. 2. The cavitation generating emission device 50 can implement surface modification (oxidation for example) by making a first liquid flow A including cavitation collide with a predetermined portion (a protrusion on a surface of a workpiece W for example) of the surface of the workpiece W. The workpiece W after the surface modification (oxidation) sucked and held by the polishing heads 12 moves onto the surface plates 14 one by one, and is pressed onto a polishing pad 16 attached to the surface plate 14 by a vertical movement driving device (not illustrated). The polishing head 12 and the polishing pad 16 are rotated in directions opposite to each other, and are relatively moved (slid), whereby the surface of the workpiece W can be polished.

Meanwhile, the workpiece W, which is the processing target, is a substrate (a disk-shaped wafer for example) formed using what can be referred to as a material difficult to process such as silicon carbide (SiC) for example, and its outer diameter and thickness are not particularly limited (for example, the outer diameter is about several centimeters to several tens of centimeters, and the thickness is about several micrometers to several millimeters). More specifically, the workpiece W is a material oxidized due to the collision of the first liquid flow A including the cavitation. In the present embodiment, a case is described where the workpiece W is made of silicon carbide (SiC).

(Polishing Apparatus)

Each of the polishing heads 12 according to the present embodiment includes a head main body 20, a holding plate 22, a driving device 26, and a pressure adjustment mechanism 28. As illustrated in FIG. 1, the head main body 20 is formed to have a tubular shape with the upper surface side closed by a top plate 20*a* and a side wall 20*b*. A configuration is employed in which the workpiece W is held (sucked and held in the present embodiment) on the lower surface of a lower plate 22*b* of the holding plate 22 (22*a*, 22*b*). The holding plate 22 is disposed inside the head main body 20, and is hung via a diaphragm 20*c* to be vertically movable from the vertical movement driving device (not illustrated).

The holding plate 22 is formed with two (upper and lower) plates 22*a* and 22*b* fixed, and an air chamber 22*d* is formed between the two (upper and lower) plates 22*a* and 22*b*. Multiple through holes 22*c* communicating with the air chamber 22*d* are formed in the lower plate 22*b*. Furthermore, a backing material (not illustrated) made of a porous elastic material is attached to the lower surface side of the lower plate 22*b*. The air in the air chamber 22*d* is sucked by an air suction device (not illustrated) to achieve vacuum (negative pressure) in the air chamber, resulting in suction effect on the backing material lower surface side through the through holes 22*c*. Thus, the workpiece W can be sucked and held on the lower surface side of the holding plate 22.

The workpiece W may be held by the holding plate 22 by means of surface tension of a liquid (water for example).

The top plate 20*a* according to the present embodiment is provided with a hollow head shaft 18. A configuration is employed in which when the head shaft 18 is rotated by a rotation driving device (not illustrated), the polishing head 12 rotates about the rotation axis of the head shaft 18.

A space surrounded by the top plate 20*a*, the side wall 20*b*, and the holding plate 22 (22*a*) is divided by a partitioning plate 25 into an atmospheric chamber 24*a* on the upper side and a pressurized chamber 24*b* on the lower side.

The polishing head 12 is coupled to the vertical movement driving device (not illustrated). Thus, a configuration is achieved in which the holding plate 22 (that is, the workpiece W) is moved toward or away from the polishing pad 16.

Reference numeral 26 denotes an air cylinder that is an example of a driving device. The air cylinder 26 has a cylinder main body fixed on the partitioning plate 25 in the atmospheric chamber 24*a*, and has a rod extending through the through hole of the partitioning plate 25 and in the pressurized chamber 24*b*. A configuration is employed in which the cylinder of the air cylinder 26 comes into contact with the upper surface of the upper plate 22*a* with a pressing pad (not illustrated) provided in between. The air cylinder 26 can locally press multiple portions at least in a circumference direction on the upper surface of the upper plate 22*a*. For example, the air cylinders 26 are formed as one air cylinder 26 that presses the center portion of the upper plate 22*a*, and four air cylinders 26 each provided at a 90° phase in plan view to be in contact with the outer circumference portion of the upper plate 22*a*. Each of the air cylinders 26 is coupled to a first control unit 32. The number and the arrangement of the air cylinders 26 are not limited to these. With the air cylinders 26 provided, the distribution of the pressure of the workpiece W against the polishing pad 16 can be adjusted.

As illustrated in FIG. 1, the polishing head 12 includes a flow path 30 through which the pressurized chamber 24*b* and the pressure adjustment mechanism 28 communicate. The pressure adjustment mechanism 28 is also coupled to the first control unit 32. The pressure adjustment mechanism 28 supplies compressed air to the pressurized chamber 24*b* through the flow path 30. With this configuration, the holding plate 22 deforms to protrude downward when the inside of the pressurized chamber 24*b* is pressurized, whereby the workpiece W can be pressed against the polishing pad 16.

The surface plate 14 according to the present embodiment is placed on a table 34 as illustrated in FIG. 1. The axial center of the rotation axis of the surface plate 14 and the axial center of the rotation axis of the polishing head 12 may be eccentric to each other. The polishing pad 16 is attached to the upper surface of the surface plate 14. The polishing pad 16 is made of polyurethane foam or hard nonwoven fabric for example.

Each table 34 is rotatably supported by a rotation driving device 38, using a bearing 36. A configuration is employed in which a shaft portion 34*a* of the table 34 is coupled to the rotation driving device 38, and is rotated by the rotation driving device 38 to make the surface plate 14 and the polishing pad 16 rotate within a horizontal plane. At the same time, the polishing head 12 is rotated, so that the lower surface of the workpiece W can be polished.

The polishing apparatus 10 according to the present embodiment has a configuration including a slurry supply unit not illustrated. The slurry supply unit provides slurry onto each of the polishing pads 16. As described below, the polishing apparatus 10 according to the present embodiment includes, for example, the surface plates 14 for respectively performing rough polishing, intermediate polishing, and finish polishing in this order. Thus, slurry corresponding to each of the polishing processes is provided to each of the surface plates 14. With the slurry supply unit provided, the polishing rate of the workpiece W can be improved.

Next, the arrangement of the polishing heads 12, the surface plates 14, and the cavitation generating emission device 50 will be described. While the arrangement of the polishing heads 12 and the surface plates 14 is not limited at all, and the numbers of the polishing heads 12 and the surface plates 14 are not limited, these members may be arranged as follows for example.

FIG. 2 is a diagram illustrating an example of arrangement of the polishing heads 12, and is a plan view (schematic view) illustrating an example of the polishing apparatus 10 according to the present embodiment. In the polishing apparatus 10 according to the present embodiment, a temporary stand 70 to and from which the workpiece W is attached and detached (loaded and unloaded) is disposed on the upper surface of a base body 72. The plurality of (four in the present embodiment) polishing heads 12 are radially disposed on the base body 72. Specifically, above the base body 72, the plurality of polishing heads 12 are radially disposed on the temporary stand 70 and the respective surface plates 14, with the head shafts 18 hung from a supporting member (not illustrated) to be independently vertically movable and rotatable. The supporting member includes a rotation driving mechanism (not illustrated) and is configured to be rotatable about the axis (including rotatable intermittently and in forward and reverse directions). With this configuration, the polishing heads 12 can rotate (revolve) about the axis, by rotating the supporting member. Furthermore, on the base body 72, the plurality of (three in the present embodiment) surface plates 14 and the table 34 are disposed on the same plane.

The temporary stand 70 is provided with the cavitation generating emission device 50. The cavitation generating emission device 50 is coupled with an orthogonal driving device 60 with a forward end portion 54*g*, described below, pointing the upper surface (that is, toward the lower surface of the workpiece W held by the polishing heads 12). The orthogonal driving device 60 is configured to be capable of moving the cavitation generating emission device 50 in an X-axis direction, a Y-axis direction, and a Z-axis direction for example. With this configuration, the liquid flow (a mixed flow of a first liquid flow A and a second liquid flow B) including cavitation can collide with a predetermined portion of the surface of the workpiece W. The cavitation generating emission device 50 will be described in detail in (Cavitation generating emission device).

Thus, the back surface of the workpiece W sucked and held by the polishing head 12 (corresponding to the polishing head 12 in a lower portion in FIG. 2) can be subjected to the surface modification (oxidation) by the cavitation generating emission device 50, and the polishing heads 12 can be sequentially moved from the temporary stand 70. As a result, a series of polishing processes can be performed, with the workpiece W subjected to the predetermined polishing (rough polishing, intermediate polishing, finish polishing) at each of the surface plates 14 as the movement destinations, and with the polished workpiece W returned onto the temporary stand 70 again and placed (unloaded) thereon. In the process, the direction and the order of the movement (rotation) of the polishing heads 12 are not limited at all. The numbers of the surface plates 14 and the polishing heads 12 are not limited, and the numbers of the surface plates 14 and the polishing heads 12 may be different from each other. The temporary stand 70 may be configured to have a loading station where the loading takes place and an unloading station where the unloading takes place separately provided. In this case, the cavitation generating emission device 50 and the orthogonal driving device 60 are provided to the loading station.

(Cavitation Generating Emission Device)

Next, the cavitation generating emission device 50 according to the present embodiment includes an inner tube 54 having a small diameter and a first outer tube 52 having a larger diameter than the inner tube 54 as illustrated in FIG. 3, and thus has a double tube structure. The inner tube 54 is fit in the first outer tube 52. The forward end portion 54*g* of the inner tube 54 has a smaller diameter than a rear end portion 54*h*, and an annular gap 52*d* (corresponding to the inner diameter of the first outer tube 52) is formed between the forward end portion 54*g* and the first outer tube 52.

The inner tube 54 includes a cavitation generating unit 54*a* and a first flow path 54*b*. The first flow path 54*b* communicates with a first pipe 80. The first liquid flow A from a liquid source (which is not illustrated and is a water source for example) of a liquid supply unit 84 is adjusted by a second control unit 86 to be in a predetermined amount, at a predetermined speed and at a predetermined pressure, and flows into the first pipe 80. Next, the first liquid flow A flows into the first flow path 54*b* from the first pipe 80. Next, the first liquid flow A passes through the cavitation generating unit 54*a*. The cavitation generating unit 54*a* includes a third tapered pipe portion 54*c* having a diameter decreasing toward the forward end portion 54*g*, a first tapered pipe portion 54*d* having a diameter decreasing toward the forward end portion 54*g* to be even smaller than that of the third tapered pipe portion 54*c*, a parallel portion 54*e* having the same diameter as the small diameter portion of the first tapered pipe portion 54*d*, and a second tapered pipe portion 54*f* having a diameter increasing toward the forward end portion 54*g*. A configuration is employed in which the first liquid flow A is squeezed in the third tapered pipe portion 54*c* and the first tapered pipe portion 54*d* to have a higher flow rate (that is, pressure decreased), passes through the parallel portion 54*e*, and in the second tapered pipe portion 54*f*, has the flow rate lowered (that is, pressure increased) and, at the same time, has the cavitation produced therein. Then, the first liquid flow A with the cavitation produced therein is discharged from the forward end portion 54*g*. The shape of the inner tube 54 is preferably changed based on the condition for producing the cavitation. For example, a configuration may be employed in which the cavitation generating unit 54*a* does not include one (or both) of the third tapered pipe portion 54*c* and the parallel portion 54*e*, and includes at least the first tapered pipe portion 54*d* and the second tapered pipe portion 54*f*.

The first outer tube 52 includes the second flow path 52*a* through which the second liquid flow B flows. The second flow path 52*a* includes a fourth tapered tube 52*b* and a communication portion 52*c*. A gap 52*d* surrounded by the fourth tapered tube 52*b* and the forward end portion 54*g* also has a squeezed shape, meaning that the second liquid flow B has a higher flow rate (that is, pressure decreased) in the gap 52*d*.

The cavitation generating emission device 50 according to the present embodiment includes a second outer tube 56. The second outer tube 56 has a communication portion 56*a* fit in the communication portion 52*c*. The second outer tube 56 communicates with a second pipe 82. The second liquid flow B from the liquid source (which is not illustrated and is a water source for example) of the liquid supply unit 84 is adjusted by the second control unit 86 to be in a predetermined amount, at a predetermined speed and at a predetermined supply pressure, and flows into the second pipe 82. Next, the second liquid flow B flows into the second outer tube 56 from the second pipe 82. Then, the second liquid flow B flows into the gap 52*d* through the inner diameter of the second outer tube 56.

The liquid supply unit 84 is configured to include a valve, a pump, a pressure adjustment mechanism, and the like (none of which is illustrated) as appropriate.

With the configuration described above, the cavitation generating emission device 50 discharges the first liquid flow A covered by the second liquid flow B. Thus, the cavitation is confined in the first liquid flow and the cavitation can be prevented from collapsing, so that the cavitation can reliably collide with a predetermined portion of the surface of the workpiece W.

The first liquid flow A flowing through the inner tube 54 (first flow path 54*b*) preferably has a higher flow rate than the second liquid flow B flowing through the first outer tube 52 (second flow path 52*a*). Thus, the cavitation can be more effectively prevented from collapsing, so that the cavitation can reliably collide with a predetermined portion of the surface of the workpiece W. The supply pressure for supplying the first liquid flow A from the liquid supply unit 84 is preferably set to be higher than the supply pressure for supplying the second liquid flow B from the liquid supply unit 84. Thus, the first liquid flow A flowing through the first pipe 80 preferably has a higher flow rate than the second liquid flow B flowing through the second pipe 82. The supply pressure is a pressure for supplying the liquid flows A and B respectively into the pipes 80 and 82 using a pump (not illustrated) or the like of the liquid supply unit 84, meaning that it is different from the pressure of the liquid flows A and B.

(Polishing Method)

The configuration of the polishing apparatus 10 according to the present embodiment is described above. The polishing apparatus 10 can also be used to perform a polishing method according to the present embodiment. Specifically, the orthogonal driving device 60 is operated to dispose the cavitation generating emission device 50 immediately below a predetermined portion of the workpiece W (for example, a protrusion on the surface of the workpiece W). Then, the liquid flows A and B respectively flow in the inner tube 54 and the second outer tube 56. Thus, the first liquid flow A flows in the inner tube 54 (first flow path 54*b*), and the second liquid flow B flows in the first outer tube 52 (second flow path 52*a*). Next, a cavitation generating emission step is performed in the cavitation generating unit 54*a*, in which the cavitation is generated in the first liquid flow A, and the first liquid flow A collides with the predetermined portion of the workpiece W. In this process, the first liquid flow A is discharged while being covered by the second liquid flow B. The first liquid flow A preferably flows in the inner tube 54 (first flow path 54*b*) at a higher flow rate than the second liquid flow B flowing in the first outer tube 52 (second flow path 52*a*). Thus, the supply pressure for the first liquid flow A may be set to be a value higher than the supply pressure for the second liquid flow B as appropriate, in accordance with the cavitation generation condition. Thus, the first liquid flow A preferably flows in the first pipe 80 at a higher flow rate than the second liquid flow B flowing in the second pipe 82. Then, the vertical movement driving device (not illustrated) makes the polishing pad 16, attached to the surface plate 14, press the surface modified workpiece W sucked and held by the polishing head 12. Then, the polishing head 12 and the polishing pad 16 are rotated in directions opposite to each other, to move (slide) relative to each other (polishing step). Thus, the surface of the workpiece W can be polished in consideration of the distribution of the recesses and the protrusions on the workpiece W and with the short-time processability improved. Preferably, the cavitation generating emission step includes a step of oxidizing the surface of the workpiece W by making the first liquid flow A collide with the predetermined portion of the workpiece W. More preferably, the cavitation generating emission step includes a step of making the second liquid flow B flow and discharging the first liquid flow A including the cavitation while being covered by the second liquid flow B. More preferably, the first liquid flow A is at lower pressure than the second liquid flow B.

EXAMPLE

As an example, the surface of the workpiece W made of silicon carbide (SiC) was polished after the surface modification (oxidation) performed by the cavitation generating emission device 50 of the polishing apparatus 10 according to the present embodiment.

First of all, qualitative analysis was performed, using X-ray photoelectron spectroscopy (XPS), on the predetermined portion of the workpiece W before being irradiated with the cavitation (that is, the mixed flow of the first liquid flow A and the second liquid flow B), and on the predetermined portion of the workpiece W after being irradiated with the cavitation. ESCALAB250 manufactured by VG Scientific was used as the device used.

Figure 4A:
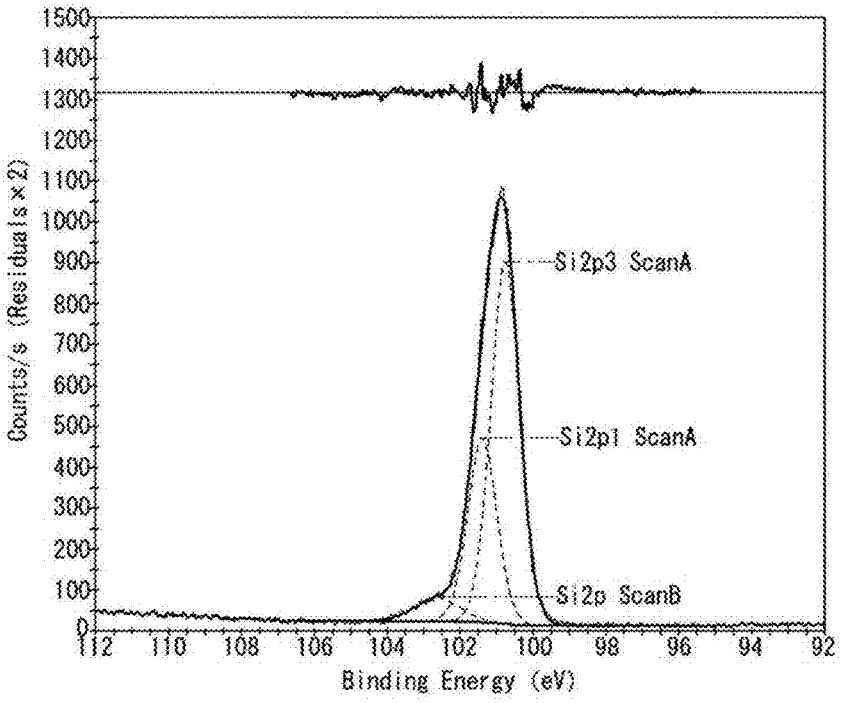
FIG. 4A illustrates a result of component analysis on a workpiece before being irradiated with cavitation according to Example of the present invention.
Figure 4B:
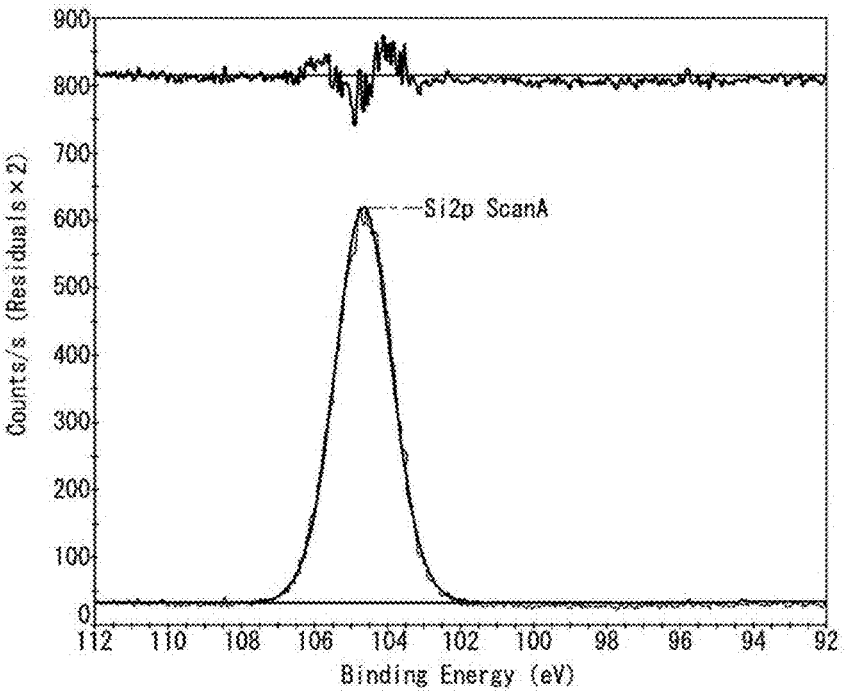
FIG. 4B illustrates a result of the component analysis on the workpiece after being irradiated with the cavitation according to Example of the present invention.

The results are illustrated in FIG. 4A and FIG. 4B. FIG. 4A illustrates a result of the component analysis on the predetermined portion of the workpiece W before being irradiated with the cavitation. The peak of Binding Energy (eV) can be found between around 100 and around 101, indicating that the component is carbon (that is, silicon carbide (SiC)). FIG. 4B illustrates a result of the component analysis on the predetermined portion of the workpiece W after being irradiated with the cavitation. The peak of Binding Energy (eV) can be found between around 104 and around 105, indicating that the component can be estimated to be silicon-based (that is, silicon dioxide ($SiO_2$)). This is because OH radicals with extremely high oxidizing power are produced when cavitation bubbles collapse, according to NPL (Fuji Electric Journal, vol. 75, No. 5, 2002, ultrasonic composite decomposition device). Thus, it can be estimated that the surface of the workpiece W made of silicon carbide (SiC) was oxidized by the cavitation generating emission device 50 according to the present embodiment.

Figure 5A:
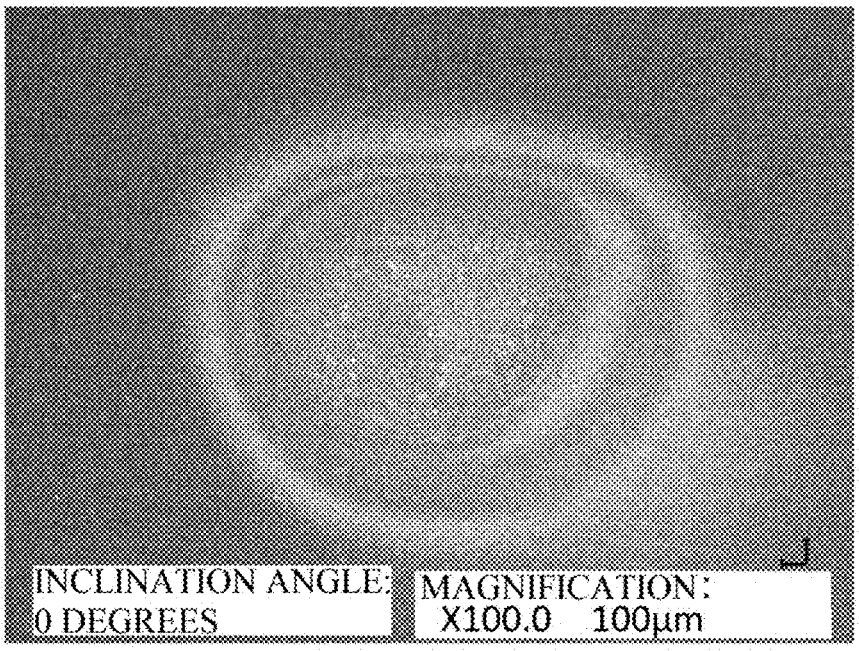
FIG. 5A is a photograph of a surface before a surface modification (oxidation) portion is polished according to Example of the present invention.
Figure 5B:
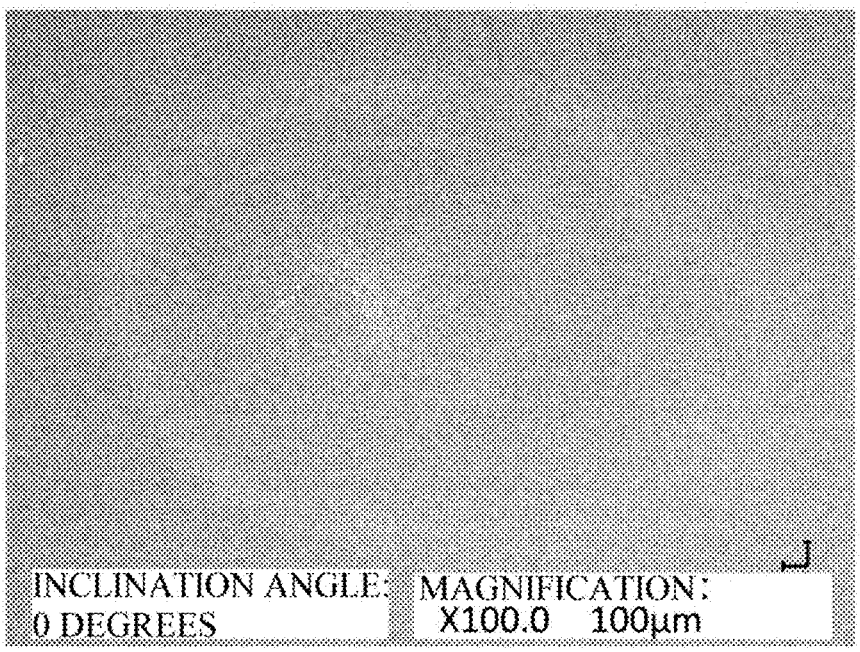
FIG. 5B is a photograph of the surface after the surface modification (oxidation) portion is polished according to Example of the present invention.
Figure 6A:
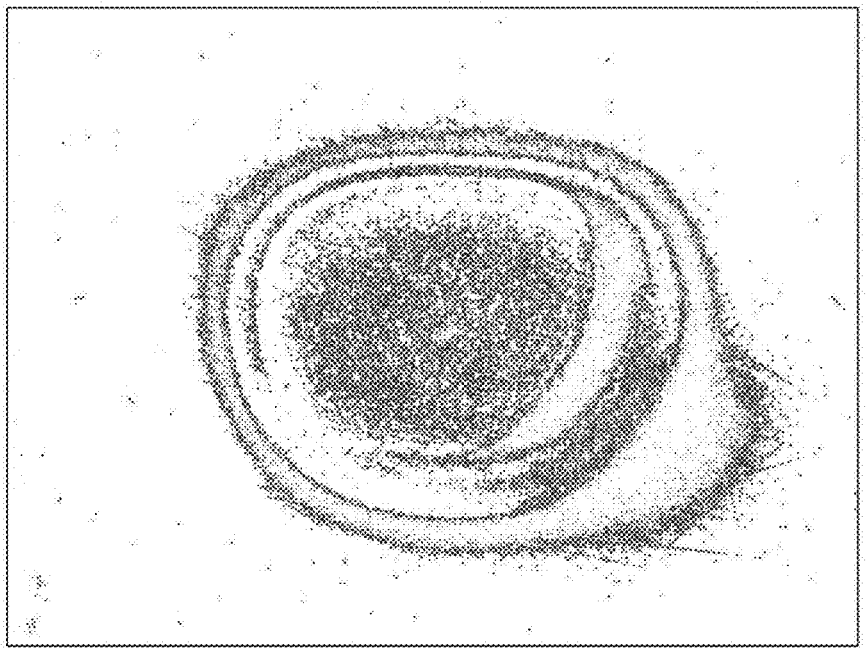
FIG. 6A is a diagram (drawing) version of FIG. 5A.
Figure 6B:
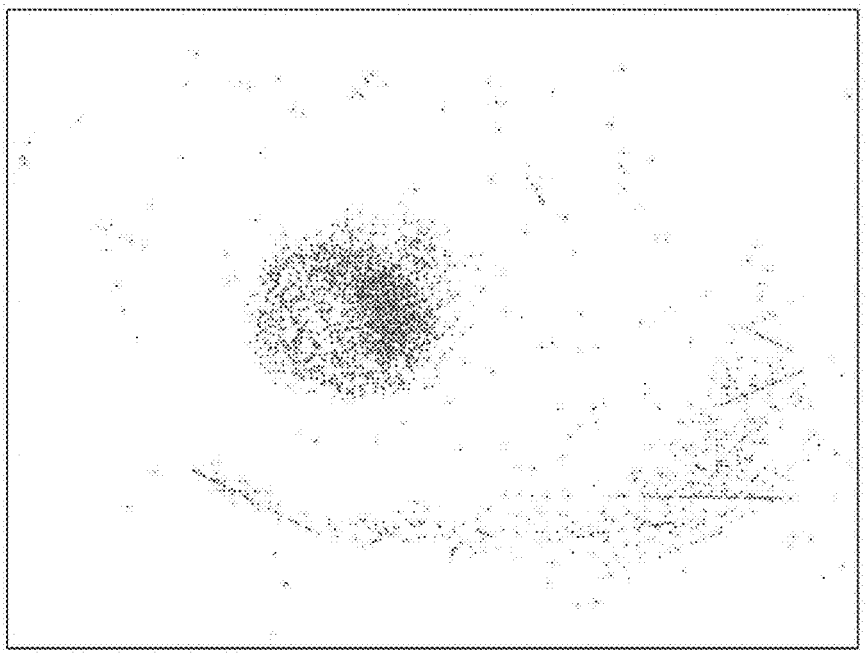
FIG. 6B is a diagram (drawing) version of FIG. 5B.

Next, FIG. 5A is a photograph of the surface of the workpiece W after being irradiated with the cavitation and before being polished. FIG. 5B is a photograph of the surface of the workpiece W after being irradiated with the cavitation and after being polished. It can be seen in FIG. 5A that the surface of the predetermined portion irradiated with the cavitation is clouded in a ring shape. Furthermore, a large number of clouded points can be found inside the ring. From these, it can be recognized that the surface of the workpiece W was modified (oxidized) by being irradiated with the cavitation. It can also be seen in FIG. 5B that the cloudiness in the ring and the clouded points are reduced from those in FIG. 5A. From these, it can be recognized that the predetermined portion of the workpiece W, the surface of which had been modified by being irradiated with the cavitation, was removed by the polishing. Thus, it was confirmed that by irradiating the workpiece W with the cavitation, the predetermined portion of the workpiece W can be oxidized, and that the oxidized portion of the workpiece W can be removed by the polish. FIG. 6A is a diagram (drawing) version of FIG. 5A. FIG. 6B is a diagram (drawing) version of FIG. 5B.

Figure 7A:
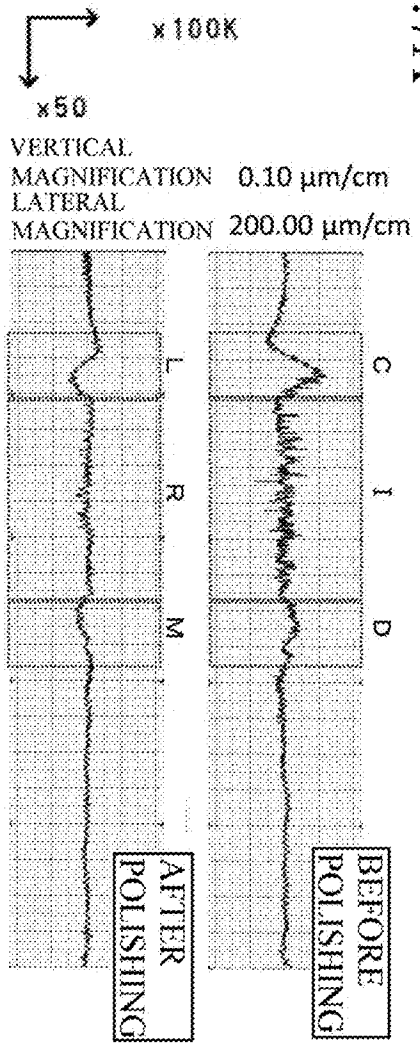
FIG. 7A illustrates a result of surface roughness measurement before and after one surface modification (oxidation) portion is polished according to Example of the present invention.
Figure 7B:
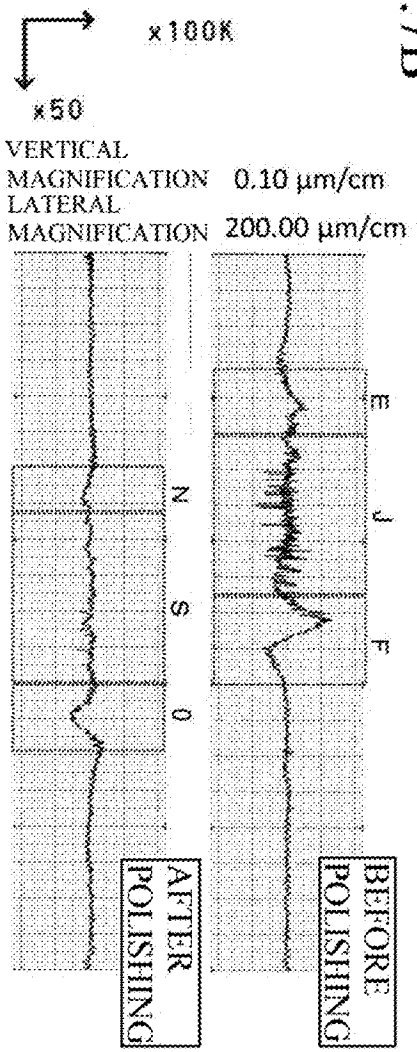
FIG. 7B illustrates a result of the surface roughness measurement before and after another surface modification (oxidation) portion is polished according to Example of the present invention.
Figure 7C:
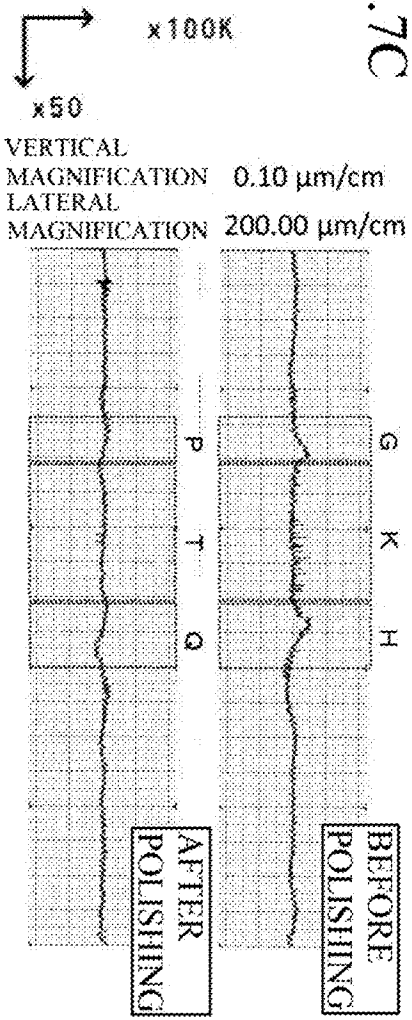
FIG. 7C illustrates a result of the surface roughness measurement before and after yet another surface modification (oxidation) portion is polished according to Example of the present invention.

Next, the state of the surface before and after the polishing was evaluated for three predetermined portions of the workpiece W oxidized, using a surface roughness meter. FIG. 7A to FIG. 7C illustrate roughness distributions in the predetermined portions of the workpiece W before and after the polishing. According to the surface roughness before the polishing in FIG. 7A to FIG. 7C, it can be seen that there are two portions with large surface roughness in left and right (C portion to H portion in the drawings), and that there are portions (I portion to K portion) on the inner side thereof where the surface roughness largely fluctuates. C portion to H portion correspond to the ring-shaped clouded portion in FIG. 5A and FIG. 6A, and I portion to K portion correspond to the clouded point portions in FIG. 5A and FIG. 6A. Next, according to the surface roughness after the polishing in FIG. 7A to FIG. 7C, it can be seen that the surface roughness is reduced (L portion to Q portion) as a result of the removal of C portion to H portion. Furthermore, it can be seen that the fluctuation in I portion to K portion is reduced and the flatness is achieved (R portion to T portion).

As described above, according to the present invention, a predetermined portion of the workpiece W is polished after local (spot-by-spot) surface modification (oxidation), whereby the distribution of recesses and protrusions on the workpiece W can be taken into consideration, and the short-time processability can be improved.

Note that the present invention is not limited to the embodiment described above, and can be modified in various ways without departing from the scope of the present invention. For example, the polishing apparatus 10 may be a double-sided polishing apparatus.

What is claimed is:

1. A polishing apparatus that polishes a workpiece, the polishing apparatus comprising a cavitation generating emission device, wherein the cavitation generating emission device has an inner tube in which a first liquid flow flows, the inner tube includes a cavitation generating unit, the cavitation generating emission device is configured to generate cavitation in the first liquid flow and make the first liquid flow collide with the workpiece, the cavitation generating emission device having a double tubular shape including the inner tube and a first outer tube and in which a rear end side of the inner tube is fit in the first outer tube, the inner tube including a first flow path communicating with the cavitation generating unit, the first outer tube having a second flow path in which a second liquid flow flows, the cavitation generating unit further including a first tapered pipe portion that has a diameter decreasing toward a forward end portion of the inner tube, and a second tapered pipe portion that communicates with the first tapered pipe portion and has a diameter increasing toward the forward end portion, the cavitation generating emission device being configured to produce the cavitation in the first liquid flow in the second tapered pipe portion and make the first liquid flow covered by the second liquid flow collide with the workpiece, and the first liquid flow flows in the inner tube at a lower pressure than the second liquid flow flowing in the first outer tube.

2. The polishing apparatus according to claim 1, wherein the workpiece is made of silicon carbide (SiC).

3. A polishing method for polishing a workpiece, the method comprising:

a cavitation generating emission step of making a first liquid flow to flow, generating cavitation in the first liquid flow, and making the first liquid flow collide with the workpiece; and a polishing step of then polishing the workpiece, wherein the cavitation generating emission step includes a step of making a second liquid flow to flow and discharging the first liquid flow including the cavitation while being covered by the second liquid flow, and the first liquid flow is at a lower pressure than the second liquid flow.

4. The polishing method according to claim 3, wherein the cavitation generating emission step includes a step of oxidizing a surface of the workpiece.

5. The polishing method according to claim 3, wherein the workpiece is made of silicon carbide (SiC).

* * * * *